United States Patent [19]

Basch

[11] 4,290,347

[45] Sep. 22, 1981

[54] CRASHWORTHY FUEL PUMP

[75] Inventor: Walter E. Basch, St. Louis, Mo.

[73] Assignee: ACF Industries, Inc., New York, N.Y.

[21] Appl. No.: 80,268

[22] Filed: Oct. 1, 1979

[51] Int. Cl.[3] ..... F01B 19/02; F04B 43/14

[52] U.S. Cl. ..... 92/102; 417/471

[58] Field of Search ..... 417/470, 471, 570, 571; 92/98 R, 102

[56] References Cited

U.S. PATENT DOCUMENTS

| | | | |
|---|---|---|---|
| 1,108,146 | 8/1914 | Deegan | 92/102 |
| 3,362,341 | 1/1968 | Quatredeniers et al. | 417/571 |
| 3,364,870 | 1/1968 | Quatredeniers et al. | 417/571 |

FOREIGN PATENT DOCUMENTS

| | | | |
|---|---|---|---|
| 744873 | 10/1952 | United Kingdom | 92/102 |
| 1335769 | 6/1971 | United Kingdom | 417/471 |

*Primary Examiner*—William L. Freeh
*Attorney, Agent, or Firm*—J. Joseph Muller

[57] ABSTRACT

A crashworthy fuel pump has a body in which is formed a fuel intake cavity, a fuel discharge cavity, and a fuel pumping chamber. The body has an open end around the periphery of which is formed a lip. A flexible diaphragm is insertable into the open end of the body and the lip is bendable over the outer margin of the diaphragm to clamp the diaphragm within the body. A housing has one end formed for abutment with the open end portion of the body. The body and the housing are clamped together to form a unified assembly. The clamp is sufficiently strong to hold the assembly together when the assembly is subjected to normal forces, but breaks apart when the assembly is subjected to abnormal forces such as occur during a crash whereby the housing and the body can move apart from each other, the movement apart helping maintain the leak integrity of the diaphragm and the body.

5 Claims, 3 Drawing Figures

CRASHWORTHY FUEL PUMP

BACKGROUND OF THE INVENTION

This invention relates to fuel pumps and, more particularly, to a crashworthy fuel pump capable of withstanding extreme forces such as occur during a crash without leaking fuel.

Because of their location in the engine compartment of an automobile, fuel pumps are susceptible to damage during a crash as the result of being struck by debris flying about in the compartment. As a consequence, fuel leaks from the pump may occur. The presence of gasoline in the engine compartment due to a broken fuel pump creates a great risk of fire and potential harm to both the vehicle and its occupants.

Federal Motor Vehicle Safety Standard (FMVSS) 30 was issued in an attempt to reduce the hazards attendant the location of the fuel pump in the engine compartment by requiring that the risk of damage to a fuel pump during a crash be minimized. To comply with this standard, various schemes have been proposed to shield the fuel pump or otherwise protect it from flying debris. However, these protective shields add weight to the vehicle, may be difficult to fit into already crowded engine compartments, and may not always prevent an object from striking a fuel pump.

SUMMARY OF THE INVENTION

Among the several objects of the present invention may be noted the provision of a fuel pump which is crashworthy; the provision of such a fuel pump to not leak fuel when struck by an object during a crash even though the fuel pump is deformed; the provision of such a fuel pump which has substantially the same envelope as a conventional, non-crashworthy fuel pump so as to be readily installed in the engine compartment of a vehicle and take up substantially the same space therein; and the provision of such of a crashworthy fuel pump which reduces or eliminates the need for protective shields or similar devices.

Briefly, a crashworthy fuel pump of the present invention is for use in an automotive fuel system comprises: a body having a first portion in which is formed a fuel intake cavity and a fuel discharge cavity and a second portion in which is formed a fuel pumping chamber. One end of each cavity is in fluid communication with the pumping chamber and the second portion of the body has an open end around the periphery of which is formed a lip. A flexible diaphragm closes the pumping chamber, the diaphragm being insertable into the open end of the second portion of the body and the lip being bendable over the outer margin of the diaphragm to clamp the diaphragm within the body. Means are provided for flexing the diaphragm to pump fuel into and out of the pumping chamber through the respective intake and discharge cavities. The flexing means are housed in a housing having one end formed for abutment with the open end portion of the body. The body and the housing are clamped together to form a unified assembly. The clamp is sufficiently strong to hold the assembly together when the assembly is subjected to normal forces, the breaks apart when the assembly is subjected to abnormal forces such as occur during a crash whereby the housing and the body can move apart from each other, the movement apart helping maintain the leak integrity of the diaphragm and the body. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 3:
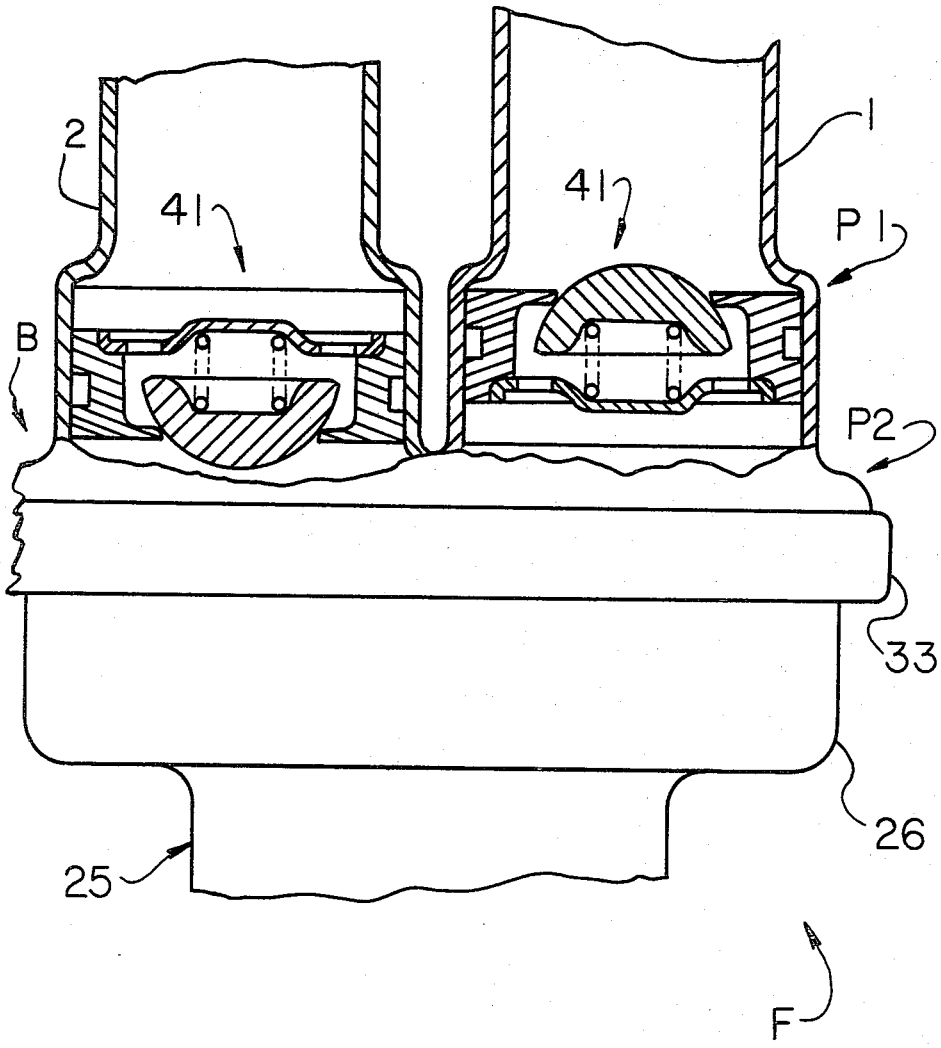
FIG. 3 is a sectional view of the fuel intake and discharge cavities of a fuel pump in which control valves are positioned.

Referring to the drawings, a fuel pump F for use in an automotive fuel system comprises a pump body, generally indicated B, which is of one-piece, thin-walled, sheet metal construction. Body B has a first portion P1 in which are formed two integral deep-drawn cylindrical, cup-shaped projections, one of which is partially shown in FIG. 1 and is indicated by reference numeral 1. Referring to FIG. 3, projection 1 defines an intake cavity for the fuel pump and a second projection 2 defines a discharge cavity for the pump. A properly oriented check valve (not shown in FIG. 1) is located in each cavity to control fuel flow into and out of the fuel pump and appropriate fittings (also not shown) are located at the outer end of each projection for connecting the fuel pump into the fuel system. Check valves and fittings of the type shown in U.S. Pat. No. 3,096,722 to Fitzgerald et al, issued July 9, 1963, are illustrative of those which may be used in fuel pump F.

Body B has a second portion P2 of a shallow cup shape, having an end wall 3 and a flaring annular peripheral wall 5 forming a fuel pumping chamber 7. One end of each cavity is in fluid communication with the pumping chamber. The lower end of body portion P2 is open and a lip 9 is formed around the periphery of this open end.

Figure 1:
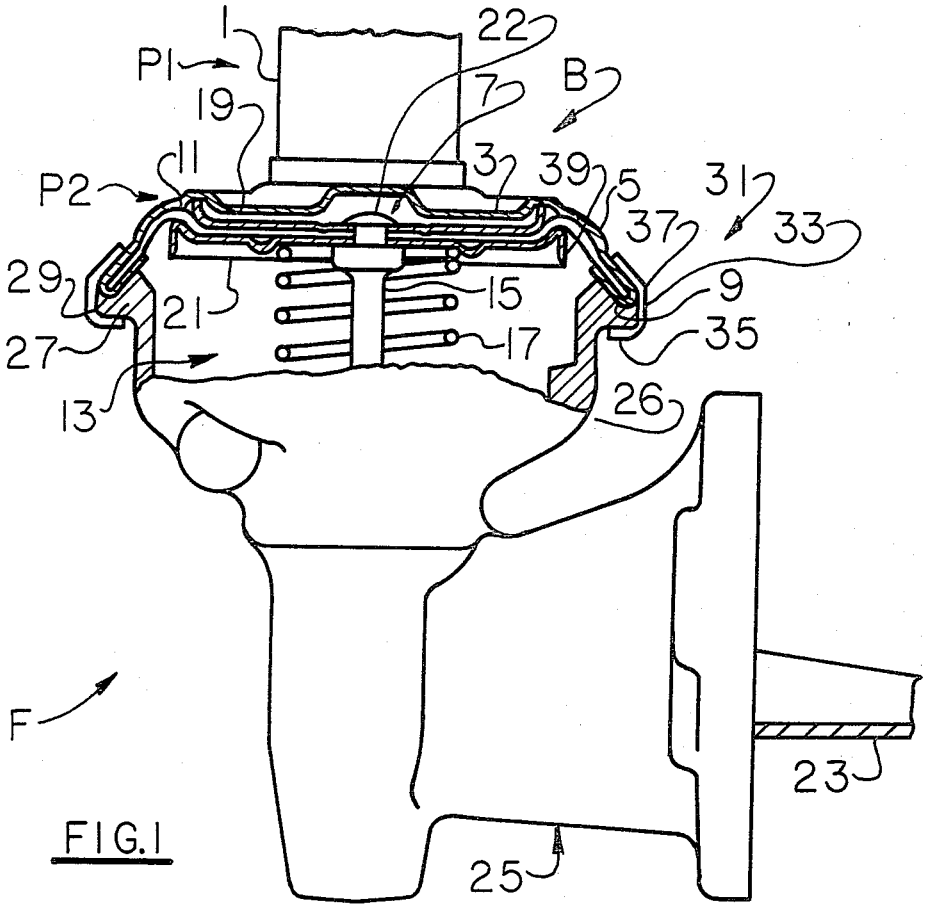
FIG. 1 is a sectional view of a crashworthy fuel pump of the present invention installable in the engine compartment of a vehicle.

An annular diaphragm 11 closes pumping chamber 7. The diaphragm consists of a relatively thin disk of flexible, fuel-resistant material such as a suitable synthetic rubber. In its unstressed condition the diaphragm is essentially flat. The diaphragm is insertable into the open end of the second portion of body B. As shown in FIG. 1, lip 9 of the pump body is bendable over the outer margin of the diaphragm to clamp the diaphragm within the pump body. The entire outer margin of the diaphragm is so clamped and the result is a fluid-tight seal between the pump body and the diaphragm.

Means, indicated generally 13, flex diaphragm 11 to pump fuel into and out of the pumping chamber 7 through the respective intake and discharge cavities. Means 13 comprises a diaphragm actuating rod 15 and a spring 17. Diaphragm 11 is sandwiched between a pair of backing plates 19 and 21 respectively. Rod 15 extends through the backing plates and the diaphragm and the end of the rod is spun over as indicated at 22. One end of spring 17 seats against the underside of plate 21. A rocker arm 23 is operable by an engine driven eccentric cam (not shown). The inner end of the rocker arm is attached to the other end of rod 15 and pulls the rod downward as it is rocked by the cam. This pulls diaphragm 11 downwardly and creates the intake stroke of the pump. Spring 17 pushes the diaphragm upwardly at the end of the intake stroke to produce the discharge stroke of the pump.

Means 13 is housed in a housing 25. the housing has a hollow conical pump head 26. The pump head has an outwardly extending circumferential rim 27, the upper face of which is downwardly and outwardly sloped. At the base of the slope is a shallow groove 29. The groove and slope form a seat for the diaphragm/pump body assembly and, in particular, the slope and groove are shaped to accommodate the bent-over portion of lip 9 after diaphragm 11 is clamped to the pump body.

Figure 2:
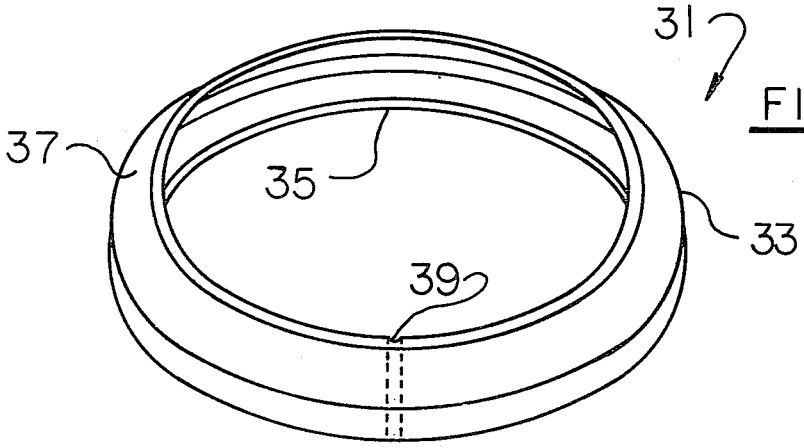
FIG. 2 is a perspective view of a clamp used in accordance with the present invention.

A means, indicated generally 31, clamps body B and housing 25 together to form a unified fuel pump assembly. As shown in FIG. 2, clamping means 31 comprises a circular ring 33 which is fitted around the body and the housing to join the two together. Ring 33 has an inturned, lower margin forming a lip 35. The inner face of this lip abuts the bottom outer surface of lip 27 when the pump is assembled. The ring has an upwardly extending circumferential side 37 whose height is such that the side extends beyond the joining surfaces of body B and housing 25. The upper portion of side 37 is crimped over the top of body B after the body and housing are brought into abutment so as to clamp the body and housing together as shown in FIG. 1.

Ring 33 has sufficient strength so as to keep the fuel pump assembly together when it is subjected to the normal forces encountered during ordinary operations of the vehicle in which the fuel pump is installed.

Ring 33 have at least one point of structural weakness such as the line of weakness indicated at 39 in FIG. 2. This causes the ring to break apart when the pump assembly is subjected to abnormal forces such as those which occur during a crash. When the ring breaks, body B of the fuel pump may move away from the housing portion of the pump and this movement apart helps maintain the leak integrity between diaphragm 11 and the body. Were the body and housing held together in the conventional manner, no separation will occur between the body and housing and the body may be deformed or ruptured by flying debris inside the compartment where the pump is installed with a fuel leak resulting. By employing a clamping means such as ring 33, the body portion of the fuel pump is able to move with the result that it will be less severely damaged if struck by debris.

Further, the seal formed between the diaphragm and body prevents fuel leakage when the body is separated from the housing. In addition, backing plate 21 has a circumferential skirt 39, the height of which is sufficiently great so the outer end of the skirt cannot contact the diaphragm even if the body of the fuel pump is deformed. This prevents the diaphragm from being punctured by the skirt and thus further safeguards against fuel leaks.

Finally, the check valves located in the inlet and discharge cavities may be replaced with control valves 41 (see FIG. 3) such as those disclosed in patent application Ser. No. 885,886, filed Mar. 13, 1978, and assigned to the same assignee as the present application. Control valves of the type disclosed in this application replace the conventional check valves located in the intake cavity of the fuel pump, the discharge cavity, or both. In any event, control valves 41 are designed to withstand large heads of fuel without permitting leaks and thus prevent fuel from entering cavity 7. This further reduces the possibility of a fuel leak occurring during or after a crash.

A fuel pump of the invention occupies the same space in the engine compartment as a conventional non-crashworthy fuel pump and, in addition, eliminates or reduces the need for protective shields or barriers whose purpose is to prevent flying debris from striking the fuel pump.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. A crashworthy fuel pump for use in an automotive fuel system comprising:

a body having a first portion in which is formed a fuel intake cavity and a fuel discharge cavity and a second portion in which is formed a fuel pumping chamber, one end of each cavity being in fluid communication with the pumping chamber and the second portion of the body having an open end around the periphery of which is formed a lip;

a flexible diaphragm closing the pumping chamber, the diaphragm being insertable into the open end of the second portion of the body and the lip being bendable over the outer margin of the diaphragm to clamp the diaphragm within the body;

means for flexing the diaphragm to pump fuel into and out of the pumping chamber through the respective intake and discharge cavities;

a housing in which the flexing means is housed, the housing having one end formed for abutment with the open end portion of the body; and means for clamping the body and the housing together to form a unified assembly, the clamping means comprising a ring fitted around the body and the housing to join the two together, the clamping means being sufficiently strong to hold the assembly together when the assembly is subjected to normal forces, but the clamping means breaking apart when the assembly is subjected to abnormal forces such as occur during a crash whereby the housing and the body can move apart from each other, the movement apart helping maintain the leak integrity of the diaphragm and the body, the clamping ring having at least one point of structural weakness, thus for the ring to break when subjected to abnormal forces.

2. A crashworthy fuel pump as set forth in claim 1 wherein the flexing means includes at least one backing plate for the diaphragm, the backing plate having a skirt therearound the height of which is sufficiently great so the diaphragm cannot contact the end of the skirt if the fuel pump assembly is deformed during a crash thereby to prevent puncturing of the diaphragm by the skirt and maintain leak integrity.

3. A crashworthy fuel pump as set forth in claim 1 further including a control valve in the fuel intake cavity to aid in preventing fuel leaks.

4. A crashworthy fuel pump as set forth in claim 1 further including a control valve in the fuel discharge cavity to aid in preventing fuel leaks.

5. A crashworthy fuel pump as set forth in claim 1 further including control valves in the fuel intake and fuel discharge cavities to aid in preventing fuel leaks.

* * * * *